United States Patent [19]

Raterman et al.

[11] Patent Number: 4,693,428

[45] Date of Patent: Sep. 15, 1987

[54] PARTICLE-TYPE SHREDDING MECHANISM

[75] Inventors: Donald E. Raterman, Deerfield; James M. Amburn, Mundelein, both of Ill.

[73] Assignee: Cummins Allison Corporation, Mt. Prospect, Ill.

[21] Appl. No.: 667,151

[22] Filed: Nov. 1, 1984

[51] Int. Cl.[4] ..... B02L 18/16

[52] U.S. Cl. ..... 241/167; 241/236

[58] Field of Search ..... 241/166, 167, 235, 236, 241/243, 242; 83/113, 114, 121, 122

[56] References Cited

U.S. PATENT DOCUMENTS 3,860,180 1/1975 Goldhammer ..... 241/236 X
4,293,988 10/1981 Biondetti ..... 29/116 AD
4,489,897 12/1984 Turner et al. ..... 241/236 X

FOREIGN PATENT DOCUMENTS 2749482 5/1979 Fed. Rep. of Germany ..... 241/293

*Primary Examiner*—Timothy V. Eley
*Attorney, Agent, or Firm*—Stephen G. Rudisill

[57] ABSTRACT

A document shredder comprising the combination of a pair of counter-rotating rolls forming integral cutting discs interleaved with each other for cutting documents fed between the rolls into multiple strips, the discs also having cutting edges extending longitudinally of the rolls for cutting the multiple strips into short segments; multiple spacers mounted along the length of each roll, each of said spacers extending into the space between a pair of adjacent cutting discs on the same roll, and multiple diverters spaced along the length of each roll in register with the discs on the respective rolls, each of the diverters having an arcuate surface in closely spaced relationship to the radially outer surfaces of one of the discs for preventing the accumulation of the short segments of the cut documents adjacent the rolls.

5 Claims, 4 Drawing Figures

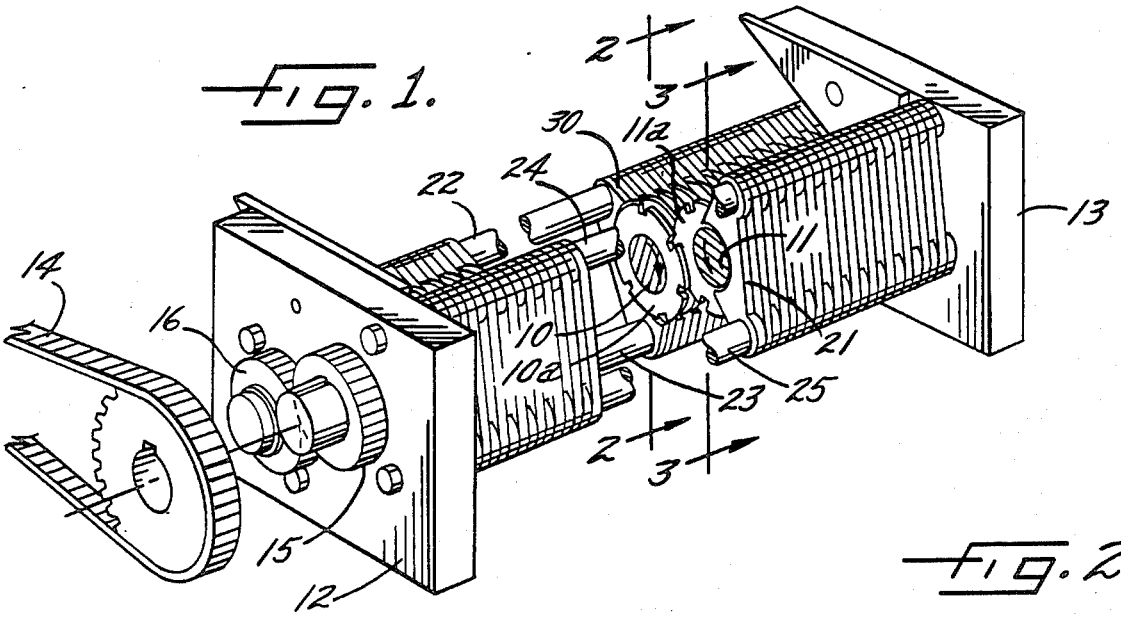
Fig. 1.
Fig. 2.
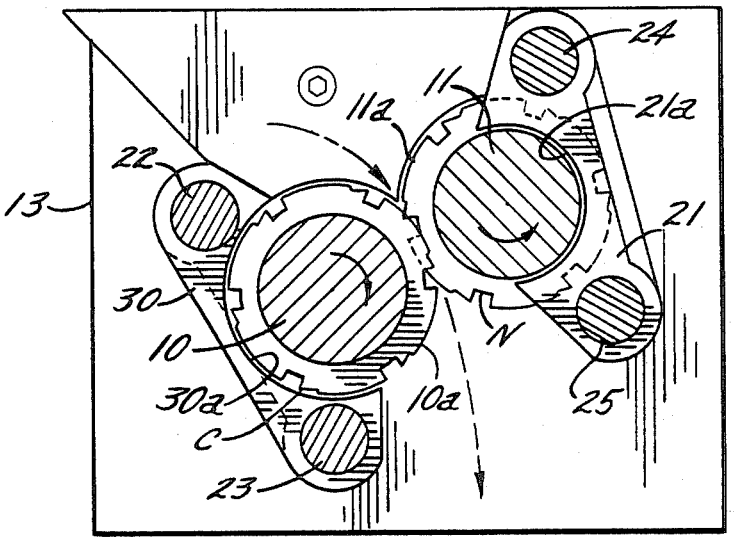
Fig. 3.
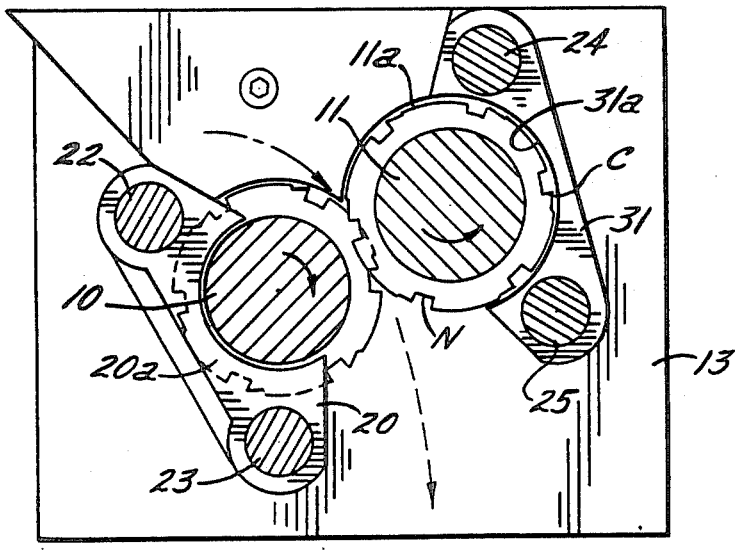
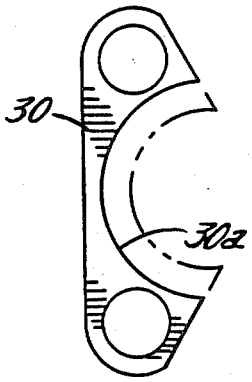
Fig. 4.

PARTICLE-TYPE SHREDDING MECHANISM

TECHNICAL FIELD

The present invention relates generally to document shredders and, more particularly, to shredders which not only cut the documents into multiple ribbons but also cut the ribbons into a multiplicity of short segments or "particles". One example of such a particle-type shredder is described in Goldhammer U.S. Pat. No. 3,860,180, issued Jan. 14, 1975 and entitled "Method and Apparatus for Destroying Documents."

DESCRIPTION OF THE INVENTION

It is a primary object of the present invention to provide an improved particle-type document shredder which avoids accumulation of the shredded particles adjacent the cutting rolls. In this connection, a related object of the invention is to provide such an improved shredder which avoids jamming and/or reduction in shredding power due to accumulation of shredded particles adjacent the cutting rolls.

It is another important object of this invention to provide such an improved particle-type document shredder which reduces the down time and increases the productivity of the shredder, while at the same time reducing the labor costs required to maintain the shredder.

A further object of this invention is to provide an improved particle-type shredder of the foregoing type which can be efficiently and economically manufactured.

Other objects and advantages of the invention will be apparent from the following detailed description and the accompanying drawings.

In accordance with the present invention, the foregoing objectives are realized by a document shredder comprising the combination of a pair of counter-rotating rolls having multiple cutting discs interleaved with each other for cutting documents fed between the rolls into multiple strips, the discs also having cutting edges extending longitudinally of the rolls for cutting the multiple strips into short segments; and diverter means cooperating with the outer surfaces of the cutting discs for preventing said short segments from accumulating adjacent the circumferential portions of the rolls where the cutting discs are not interleaved with each other. In the preferred embodiment of the invention, the diverter means are spaced along the length of each roll and have arcuate surfaces in closely spaced relationship to the radially outer surfaces of the cutting discs on the respective rolls for preventing accumulation of the short segments of the cut documents adjacent the counter-rotating rolls.

BRIEF DESCRIPTION OF THE DRAWINGS

FIG. 1 is a perspective view of a document shredding mechanism embodying the present invention, with portions thereof broken away to show the internal structure;

FIG. 2 is an enlarged section taken generally along the line 2—2 in FIG. 1;

FIG. 3 is an enlarged section taken generally along the line 3—3 in FIG. 1;

FIG. 4 is a plan view of one of the diverters included within the shredding mechanism of FIGS. 1–3.

While the invention will be described in connection with certain preferred embodiments, it will be understood that it is not intended to limit the invention to those particular embodiments. On the contrary, it is intended to cover all alternatives, modifications and equivalent arrangements as may be included within the spririt and scope of the invention as defined by the appended claims.

BEST MODE FOR CARRYING OUT THE INVENTION

Turning now to the drawings, there is shown a document shredding mechanism having a pair of cutting rolls 10 and 11 journalled in a pair of frame plates 12 and 13 enclosed by a housing (not shown) through which documents are fed between the rolls 10 and 11. The rolls 10 and 11 are driven by an electric motor through a drive belt 14 and gears 15, 16 which cause the two rolls to rotate in opposite directions, as indicated by the arrows in FIGS. 2 and 3. Thus, documents fed downwardly into the nip of the two rolls 10, 11 are gripped by the rolls and drawn downwardly therebetween.

Each of the two cutting rolls 10 and 11 comprises a multiplicity of longitudinally spaced cutting discs 10*a* and 11*a*, respectively. These cutting discs 10*a* and 11*a* have sharp corners and are interleaved with each other so that they cut a document passing between the two rolls 10 and 11 into a multiplicity of thin strips. That is, each pair of opposed surfaces of the interleaved discs 10*a*, 11*a* produces a scissors-like cutting action which slices the document into multiple strips.

In order to cut the multiple strips into short segments, each cutting disc 10*a* and 11*a* has a plurality of longitudinal cutting edges C spaced at equal intervals around the circumference thereof. In the particular embodiment illustrated, these longitudinal cutting edges C are formed by notches N formed at 60° intervals around each cutting disc 10*a* and 11*a*. The outer surface of each disc is beveled adjacent the trailing edge of each notch N to form an acute angle at each cutting edge C, as can be seen in FIG. 2.

In order to permit a relatively constant driving force to be applied to the cutting rolls, the notches N formed in each set of cutting discs 10*a* or 11*a* follow helical paths along the lengths of the respective cutting rolls. This causes the longitudinal cuts to be made sequentially along the length of the cutting rolls 10 and 11, rather than forming all the longitudinal cuts simultaneously.

The shredding mechanism as described thus far is essentially the same as that described in the aforementioned Goldhammer U.S. Pat. No. 3,860,180. Although that mechanism satisfactorily shreds document into the desired small segments or particles, it has been found that the particles tend to accumulate and build up on the outboard side of one or both of the cutting rolls 10 and 11, eventually leading to an increased drag on the cutting rolls. This increased drag reduces the cutting efficiency and can even cause the shredder to jam. To avoid these problems in actual use, the operator learns to periodically shut down the machine, remove the cover and clean out the accumulation of document particles. This is not only a labor-intensive operation, but also seriously reduces the productivity of the shredding machine.

Although not shown in the Goldhammer U.S. Pat. No. 3,860,180, the commercial shredding machines that have been manufactured with the cutting rollers shown in that patent have included a multiplicity of spacers 20 and 21 disposed between the cutting discs of the respective rolls 10 and 11. The spacers 20 are mounted on a pair of stationary rods 22 and 23 extending between the two frame plates 12 and 13 and affixed thereto. Similarly, the spacers 21 are mounted on a pair of stationary rods 24 and 25 extending between the frame plates 12 and 13 adjacent the cutting roll 11. Each of the spacers 20 and 21 extends inwardly between a pair of adjacent cutting discs 10*a* or 11*a*, with arcuate surfaces 20*a* and 21*a* fitting closely around the outboard halves of the solid central portions of the rolls 10 and 11, respectively. That is, the arcuate surfaces 20*a* and 21*a* of the spaces 20 and 21 respectively, have a radius of curvature which is only slightly larger than the radius of the solid central portions of the cutting rolls 10 and 11, as can be most clearly seen in FIGS. 2 and 3.

In accordance with the present invention, multiple diverters are spaced along the length of each roll and have arcuate surfaces in closely spaced relationship to the radially outer surfaces of the cutting discs on the respective rolls for preventing the short segments of the cut documents from accumulating adjacent the counter-rotating rolls. Thus, in the illustrative embodiment, a multiplicity of generally C-shaped diverters 30 and 31 are mounted in stationary positions along the lengths of the two cutting rolls 10 and 11, in register with the cutting discs 10*a* and 11*a* on the respective rolls. These diverters 30 and 31 are located on the outboard sides of the cutting rolls, i.e., on the opposite sides of the rolls from the sides where the cutting discs 10*a* and 11*a* are interleaved. The inboard edges 30*a* and 31*a* of the diverters 30 and 31 form an arcuate surface complementary to the outermost surfaces of the cutting discs 10*a* and 11*a* and are located closely enough to the disc surfaces to prevent the accumulation of document particles adjacent the discs. That is, the radius of curvature of the diverter edges 30*a*, 31*a* is only slightly greater than the radius of the cutting discs 10*a*, 11*a*.

The effect of the diverters 30 and 31 is to prevent the shredded document particles from accumulating along the outboard surfaces of the cutting rolls 10 and 11. More specifically, the particles are forced to fall down into a collection hopper directly beneath the cutting nip of the two rolls 10 and 11, thereby preventing jamming and maintaining a relatively constant operating efficiency for the shredding mechanism. More importantly, there is no need for the operator to periodically shut down the machine and clean out the acumulated particles of shredded documents.

In the particular embodiment illustrated, the diverters 30 and 31 are mounted on the same stationary rods 22, 23 and 24, 25 on which the spacers 20 and 21 are mounted. The diverters 30 and 31 are fastened in the desired positions on the mounting rods 24 and 25 by the spacers 20 and 21 which extend into the open spaces between the cutting discs. That is, the thickness of the diverters 30 and 31 (in the longitudinal direction) is slightly greater than the thickness of the cutting discs 10*a* and 11*a*, and the thickness of the spacers 20 and 21 is slightly smaller than the width of the space between adjacent discs 10*a* or 11*a*; consequently, when the spacers 20 or 21 and the diverters 30 or 31 are stacked together on the rods 22, 23 or 24, 25, they hold each other in exactly the desired positions, in register with the discs 10*a* or 11*a* and the spaces therebetween.

It is preferred that the arcuate edges 30*a* and 31*a* of the respective diverters encompass at least half of the circumference of the solid central portions of the rolls 10 and 11. In the particular embodiment illustrated, these arcuate surfaces encompass 190° of the circumference of the rolls 10 and 11. It has been found that diverters encompassing at least 180° of the roll circumference are particularly effective in preventing the accumulation of the shredded document particles.

As can be seen from the foregoing detailed description, the present invention provides an improved particle-type document shredder which avoids accumulation of the shredded particles adjacent the cutting rolls, thereby avoiding jamming and/or reduction in shredding power due to such accumulations. This improved mechanism reduces the down time and increases the productivity of the shredder, while at the same time reducing labor costs required to maintain the shredder. Furthermore, the diverters utilized in this invention can be efficiently and economically manufactured, adding a relatively small increment to the cost of the overall shredding mechanism.

We claim as our invention:

1. A document shredder comprising the combination of a pair of spaced apart counter-rotating particle-type document shredder rolls forming integral cutting discs the cutting discs on one roll being interleaved with the cutting discs on the other roll for cutting documents fed between the rolls into multiple strips each disc on a respective roll being spaced from an adjacent disc on the same roll, said discs also having cutting edges extending longitudinally of the rolls for cutting said multiple strips into short segments, multiple spacers mounted along the length of each roll, a spacer extending into each space between a pair of adjacent cutting discs on the same roll and extending around only a portion of the circumference of the roll on the side thereof which is substantially opposite to the space between the rolls, and multiple diverters spaced along the length of each roll a diverter being in register with each of a respective cutting disc on the respective rolls, each of said diverters having an arcuate surface having end portions located radially outwardly of the respective cutting disc and closely adjacent to the peripheral outer surfaces respective of said disc on the side thereof which is substantially opposite to the space between the rolls for preventing the accumulation of said short segments of the cut documents adjacent said rolls.

2. A document shredder as set forth in claim 1 wherein said diverters are located on the opposite sides of said rolls from the sides where said cutting discs are interleaved.

3. A document shredder as set forth in claim 1 wherein said arcuate surfaces of said diverters encompass at least 180° segments of the circumference of said respective cutting disc.

4. A document shredder as set forth in claim 1 wherein the width of a diverter, in the direction of the axes of said rolls, is at least as wide as the width of an adjacent cutting disc.

5. A document shredder as set forth in claim 1 wherein said diverters and said spacers are mounted on common mounting rods and stacked against each other.

* * * * *